United States Patent [19]

Porcaro

[11] Patent Number: 4,882,915

[45] Date of Patent: Nov. 28, 1989

[54] COMBINED LOCKET AND PHOTO HOLDER

[76] Invenfor: Eileen L. Porcaro, 13608 Valleyheart Dr., Sherman Oaks, Calif. 91423

[21] Appl. No.: 204,298

[22] Filed: Jun. 9, 1988

[51] Int. Cl.[4] ..... A44C 15/00

[52] U.S. Cl. ..... 63/19; 63/18

[58] Field of Search ..... 40/610, 617; 63/18, 63/19

[56] References Cited

U.S. PATENT DOCUMENTS

| | | | |
|---|---|---|---|
| 711,516 | 10/1902 | Miller | 63/19 |
| 2,731,812 | 1/1956 | Sullivan | 63/19 X |
| 3,309,805 | 3/1967 | Thomas | 40/617 |

FOREIGN PATENT DOCUMENTS

| | | | |
|---|---|---|---|
| 70861 | 11/1915 | Switzerland | 63/19 |

*Primary Examiner*—James R. Brittain

*Attorney, Agent, or Firm*—Roger A. Marrs

[57] ABSTRACT

An article of jewelry is disclosed having a separable housing positionable into a first open position and a second closed position. A plurality of photo holders are hingeably connected together so as to extend in side-by-side relationship from the housing when the housing is separated and to fold over upon themselves for storage inside the housing when the housing is in its second closed position. A releasable clamp secures the housing together when in its second closed position and a carrying chain is employed from which the housing downwardly depends. Each photo holder is centrally recessed to receive and mount a picture. The article is composed of either metal or plastic.

3 Claims, 1 Drawing Sheet

COMBINED LOCKET AND PHOTO HOLDER

BACKGROUND OF THE INVENTION

1. Field of the Invention

The present invention relates to articles of jewelry and more particularly to a combined locket and photo holder having a housing adapted to enclose a plurality of photo holders in a stored position and adapted to open for release of the photo holders so that the plurality of holders may be extended for photo viewing in a second position.

2. Brief Description of the Prior Art

In the past, it has been the conventional practice to place photos in a plurality of holders which are joined together by hinge means and, in some instances, the holders may be folded over upon themselves for storage purposes. In some instances, a separate enclosure or housing for storing the pictures is provided, and when manufactured or constructed in miniature, the housing can be a form of jewelry which is pinned or suspended from the neck or clothing of the user. Therefore, such an article is useful for its ornamental value and may also be used for storing the plurality of photos when not being viewed.

Problems and difficulties have been encountered with such prior housings and foldable photo holders which may be stored therein, which stem largely from the fact that it is difficult to place miniature photos on the holders so that they will stay in place and will not be dislodged after multiple deployments from storage to open positions and vice versa. Also, the weight of the housing and the plurality of photo holders greatly restricts the use of the device as an article of jewelry. Also, it is difficult to provide a suitable release means for securing the housing in a closed position so that the plurality of photo holders are stored therein and having such a release means operable to open the housing for deployment of the photo holders so that the viewer can visually inspect the photos. The latch should be relatively smooth so as not to catch or protrude into a snagging position which again would greatly detract from its value as an article of jewelry.

Therefore, it is among the primary objects of the present invention to provide an article of jewelry which includes a housing having release means for permitting deployment of a plurality of photo holders into an operative position from its storage position so that the photos may be readily viewed when desired. The article should be light in weight and be relatively smooth so that all its surfaces are coextensive to avoid projection, extension or protruding members which would normally snag or catch.

SUMMARY OF THE INVENTION

Accordingly, the above problems and difficulties are obviated by the present invention which provides a novel housing for storing a plurality of photo holders which are hingeably connected to one another so as to be folded over upon one another into a stack nested within the housing for storage. Releasable means are provided on the housing for opening the housing to permit deployment of the photo holders into an extended line so that the holders are arranged in side-by-side relationship exposing individual photos carried on each of the holders.

The releasable means may include a clamp which holds the housing into a first open position permitting deployment of the photo holders and which permits the housing to be placed in a second closed position for storage of the photo holders. Means are provided for attachment to the person or clothing of the wearer so that the article of jewelry constitutes a combined locket and photo holder. Preferably, the composition of the article of jewelry is of a lightweight composition and a variety of means for mounting individual photos on each of the respective photo holders is provided.

Therefore, it is among the primary objects of the present invention to provide a combined locket and photo holder that may be readily manipulated to an open position so that the photo holders extend outwardly from a housing and wherein the photo holders may be folded over upon themselves for storage within the holder.

Another object of the present invention is to provide a novel article of jewelry having a plurality of photo holders arranged in end-to-end relationship by hinge means and wherein the holders may be stored in a housing when not in their extended position.

Another object of the present invention is to provide a novel article of manufacture which is relatively light in weight and includes a plurality of photo holders adapted to be stored within a housing which includes clamp means for holding the housing closed to store the holders.

Another object of the present invention is to provide a novel article of manufacture that may be composed of a lightweight material, such as plastic, and includes a housing having a first position for storing a plurality of photo holders and a second position which is open to permit extension of the photo holders and which further includes a clasp means for closing the housing about the plurality of holders in the stored position.

Still a further object of the present invention is to provide an article of jewelry having a housing for holding a plurality of photo holders wherein each of the photo holders may retain an individual photo thereon by means of adhesive, slideable engagement or bonding so that the individual photo is held in a recessed location on the respective holder.

BRIEF DESCRIPTION OF THE DRAWINGS

The features of the present invention which are believed to be novel are set forth with particularity in the appended claim. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
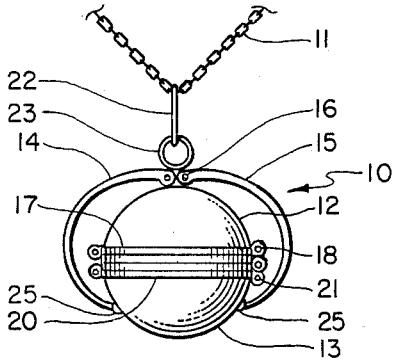
FIG. 1 is a front elevational view of the novel locket and photo holder combination incorporating the present invention.

Referring to FIG. 1, the novel locket and photo holder of the present invention is illustrated in the general direction of arrow 10 which is arranged for suspension from a chain 11 as an ornament. The locket and photo holder combination includes a housing comprising an upper base member 12 and a lower member 13 which are held together by means of a clasp. The clasp is illustrated in the form of a pair of tongs 14 and 15 which are pivotally carried at their adjacent ends to the apex of base member 12. A typical pivot connection is illustrated by numeral 16. The clasp is illustrated in its closed position retaining the housing members 12 and 13 together into a unitary ornamental construction.

It is to be particularly noted that the invention further includes a plurality of photo holders such as is illustrated by numeral 17 which is hingeably coupled to one side of the base member 12 by hinge means 18. The plurality of photo holders are arranged to be hingeably connected to one another and adapted to be folded over upon one another to comprise a stack such as illustrated in FIG. 1. The bottom photo holder of the stack, as identified by numeral 20, is hingeably carried to the bottom member 13 by hinge connection 21. Therefore, it can be seen that the stack of photo holders, when in their stored position as shown in FIG. 1, are disposed between the opposing surfaces of the members 12 and 13 respectively. When arranged in this manner, the edge marginal regions or periphery of the photo holders are exposed and the housing members 12 and 13 do not enclose or encompass the stack of photo holders.

As an ornament, the combined housing and holders may be suspended from the chain 11 by intercoupling with mounting rings 22 and 23 respectively.

Figure 2:
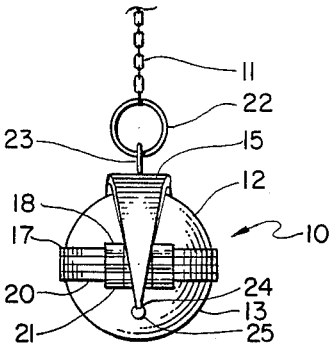
FIG. 2 is a side elevational view of the locket and photo holder combination.

Referring now in detail to FIG. 2, a side elevational view is illustrated wherein it can be seen that the extreme free end of the clasp member 15 includes a terminating ball 24 which snaps into an opening 25 for releasable retention therewith. Therefore, no sharp end or protrusion is available which would normally snag or catch in the wearer's clothing. The opening or hole 25 is placed in the side of the lower member 13 and a pair of such openings is provided on opposite sides so as to receive the ends of the clasp members 14 and 15 respectively. When so positioned, a snap lock arrangement occurs between the ball ends on the clasp members and the respective holes or openings so that the stack of photo holders is sandwiched between the opposing surfaces of the upper and lower housing members 12 and 13.

Figure 3:
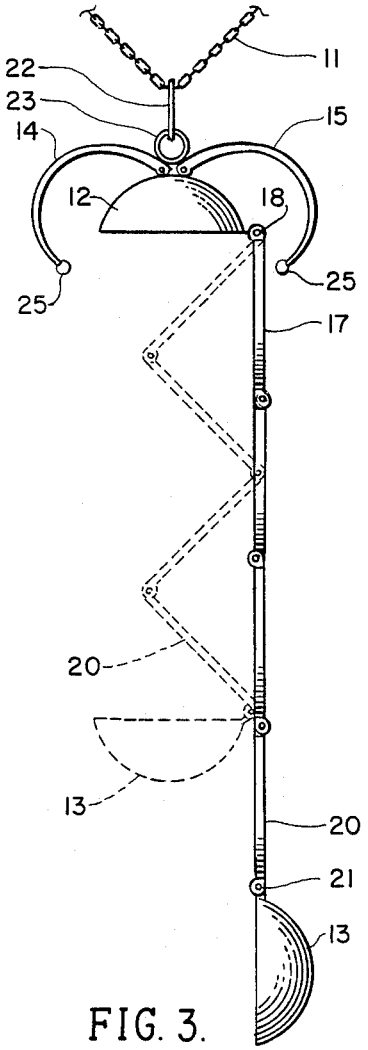
FIG. 3 is a view similar to the view of FIG. 1 illustrating deployment of the respective plurality of photo holders.

Referring now in detail to FIG. 3, it is noted that the clasp members 14 and 15 have been pivoted outwardly on their pivot mounts with respect to the base housing member 12 so that the lower or bottom member 13 has been released. As shown in broken lines, as release occurs, the bottom member 13 expands and the plurality of photo holders arranged in the stack are deployed via the pull of gravity into a hanging relationship from the base member 12 via the hinge 18. As shown in solid lines, the photo holders have been completely deployed, and the weight of the bottom member holds the photo holders in the fully deployed or extended position.

Figure 4:
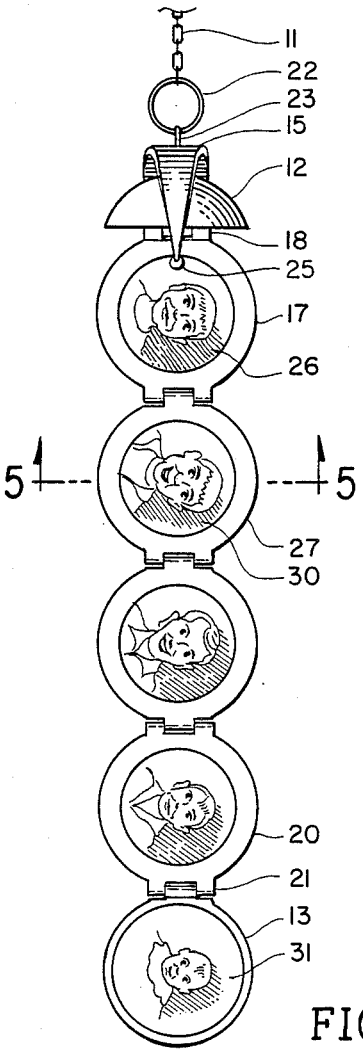
FIG. 4 is a view similar to the view of FIG. 2 illustrating deployment of the photo holders as illustrated in FIG. 3.
Figure 5:
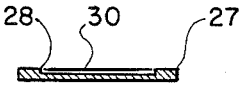
FIG. 5 is a transverse cross-sectional view of a photo holder as taken in the direction of arrows 5—5 of FIG. 4.

As shown more clearly in FIG. 4, each of the respective photo holders, such as holder 17, serves to mount a portrait picture, as indicated by numeral 26. Preferably, each of the holders, such as a holder 27 and as shown in FIG. 5, is formed with a depression or recess 28 into which the photo, such as photo 30, is mounted. Securement of the photo may be by bonding, adhesive or the photo may be slid into position by having a slotted arrangement to accommodate mounting of the photo on the respective holder.

It is also to be noted in FIG. 4 that the bottom portion 13 of the housing may be employed for mounting a photo, as indicated by numeral 31, so that a maximum number of photos can be accommodated by the device. If desired, an additional photo can also be mounted on the underside of the housing base member 12 against which the opposing surface of the photo holder 17 can be positioned when the plurality of photo holders are arranged in their storage condition.

Therefore, it can be seen from the foregoing that the novel locket and photo holder combination of the present invention provides a lightweight and convenient means for providing exposure for a plurality of miniature photos. Preferably, the composition of the device can be made from plastic so as to be extremely lightweight or, if desired, a lightweight metal may be employed. The latch comprising the clasp means is nonfrictional and is of a snap-lock nature so that sharp points do not exist which would normally catch in the wearer's clothing or fabric.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. An article of jewelry comprising:

a housing having a pair of identical half members;

a plurality of photo holders hingeably coupled together in end-to-end relationship;

said plurality of photo holders terminating at its opposite ends in end photo holders, each of which is hinged to a respective one of said housing half members;

said plurality of photo holders adapted to be folded over upon each other to form a stack between said housing half members constituting a storage position and to be extended in a line constituting an operative position exposing the opposite surfaces of each of said photo holders; and means provided on each of said photo holders for mounting a photo so as to be visually exposed when said photo holders are in said operative position;

clasp means for releasably coupling said half members together separated by said stack of photo holders when in said storage position;

said clasp means includes a pair of pivotally mounted arcuate members extending about said stack of photo holders and having rounded ends in snap-lock engagement with receiving holes in said half members respectively.

2. The invention as defined in claim 1 wherein:

said half members include photo mounting means on their respective sides facing said end photo holders when in said storage position.

3. The invention as defined in claim 2 wherein:

said half members and said photo holders are composed of a lightweight material including plastic-like materials.

* * * * *